US008292474B2

(12) United States Patent
Ho et al.

(10) Patent No.: US 8,292,474 B2
(45) Date of Patent: Oct. 23, 2012

(54) OPTIC LENS ASSEMBLY

(75) Inventors: Yen-Wei Ho, Taichung (TW); Pei-Wen Ko, Taichung (TW)

(73) Assignee: Genius Electronic Optical Co., Ltd., Taichung (TW)

( * ) Notice: Subject to any disclaimer, the term of this patent is extended or adjusted under 35 U.S.C. 154(b) by 232 days.

(21) Appl. No.: 12/591,518

(22) Filed: Nov. 23, 2009

(65) Prior Publication Data

US 2011/0058380 A1 Mar. 10, 2011

(30) Foreign Application Priority Data

Sep. 4, 2009 (TW) ..... 98129956 A

(51) Int. Cl.
*F21V 5/04* (2006.01)

(52) U.S. Cl. ..... 362/335; 362/311.1; 362/311.02

(58) Field of Classification Search ..... 362/311.02, 362/311.09, 311.1, 311.14, 311.15, 335; 313/512
See application file for complete search history.

(56) References Cited

U.S. PATENT DOCUMENTS

| | | | | |
|---|---|---|---|---|
| 7,019,918 | B2 * | 3/2006 | Wallerstein et al. | 359/725 |
| 7,348,723 | B2 * | 3/2008 | Yamaguchi et al. | 313/501 |
| 7,800,124 | B2 * | 9/2010 | Urano et al. | 257/98 |
| 7,988,338 | B2 * | 8/2011 | Zhou | 362/311.02 |
| 2008/0101063 | A1 * | 5/2008 | Koike et al. | 362/231 |
| 2008/0239722 | A1 * | 10/2008 | Wilcox | 362/268 |
| 2011/0235338 | A1 * | 9/2011 | Chen et al. | 362/311.02 |

* cited by examiner

*Primary Examiner* — Jong-Suk (James) Lee
*Assistant Examiner* — Tsion Tumebo
(74) *Attorney, Agent, or Firm* — Raymond Y. Chan; David and Raymond Patent Firm

(57) ABSTRACT

An optic lens assembly includes a platform, and an optic lens including an incident surface and a projection surface on two opposite sides is arranged to an outer side of the platform. The incident surface consists of a plurality of oval-shaped surfaces. A first oval-shaped incident surface and a second oval-shaped incident surface are formed side by side to the incident surface. The two adjacent oval-shaped incident surfaces are concave for receiving an illuminating component. The projection surface also consists of a plurality of oval-shaped surfaces. A first oval-shaped projection surface and a second oval-shaped projection surface are formed side by side to a center area of the projection surface. Two symmetric outer connecting surfaces are formed to two lateral sides of the projection surface. The two adjacent oval-shaped projection surfaces are convex and larger than the incident surface.

20 Claims, 8 Drawing Sheets

OPTIC LENS ASSEMBLY

FIELD OF THE INVENTION

The present invention relates to optic lens, and particular to an optic lens assembly capable of refracting and reflecting light from a LED and having wider transverse projection and illuminance over standard.

DESCRIPTION OF THE PRIOR ART

Accordingly, the inventor of the present invention once applied an invention of "Lens for illuminating LED" claiming a lens assembly having a concave incident surface and a convex projection surface arranged to a relative outer side of a platform. The incident and projection surfaces are both formed by a part of an oval-shaped surface.

For the purpose of achieving better performance, the inventor was keeping researching and developing and finally successful in providing the present invention.

SUMMARY OF THE PRESENT INVENTION

The primary object of the present invention is to provide an optic lens assembly capable of distributing light from a LED with an illuminating angle between 90 to 135 degrees defined by a Full Width at Half Maximum (FWHM) and having an intensity of illumination above 300 cd/klm at a perpendicular angle of 60 degrees and vertical angle between 65 to 95 degrees.

To achieve above object, the present invention provides an optic lens assembly including a platform having an incident surface and a projection surface on two opposite sides to a relative outer side of the platform.

The incident surface consists of a plurality of curved surfaces. A first oval-shaped incident surface and a second oval-shaped incident surface are formed side by side to a center area of the incident surface. The two adjacent oval-shaped incident surfaces are concave for receiving an illuminating component. The illuminating component is a light emitting diode, and the light emitting diode has an illuminating angle between 90 to 135 degrees defined by a Full Width at Half Maximum (FWHM) of the light emitting diode. Two symmetric inner connecting surfaces are formed to two lateral sides of the incident surface. The inner connecting surfaces will guide the transverse light so as to achieve a desire distribution of illumination.

The projection surface also consists of a plurality of oval-shaped surfaces. A first oval-shaped projection surface and a second, oval-shaped projection surface are formed side by side to a center area of the projection surface. Two symmetric outer connecting surfaces are formed to two lateral sides of the projection surface. The two adjacent oval-shaped projection surfaces are convex and larger than the incident surface.

Through the optic lens assembly, the illuminating device will have a better illuminance with an intensity of illumination above 300 cd/klm at a perpendicular angle of 60 degrees and vertical angle between 65 to 95 degrees.

Moreover, the optic lens assembly further has a retaining unit for connecting a predetermined illumination device. The retaining unit can be varied depending on the illumination device applied on it. In the following embodiment, the platform has symmetric concave notch on four corners thereof and two pins formed to a side of the platform opposite to the incident surface. The pins locate diagonally by an opening to the incident surface.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

A preferable embodiment of the present invention is illustrated in FIGS. 1 to 8. An optic lens assembly according to the present invention has a platform 30, and an optic lens includes incident surface 10 and a projection surface 20 on opposite surfaces of the lens is arranged to a relative outer side of the platform 30.

Figure 1:
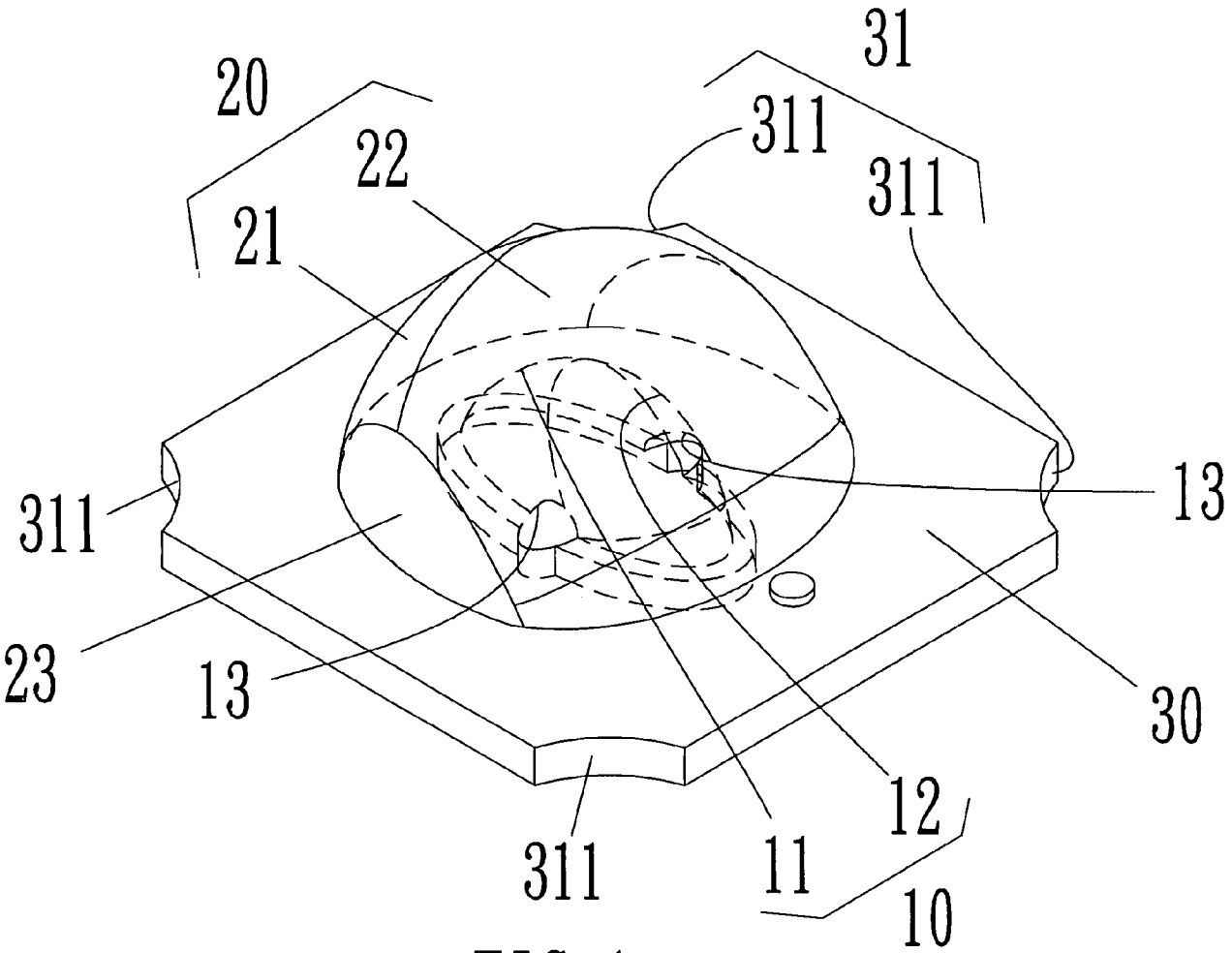
FIG. 1 is a prospective view showing a preferable embodiment of the present invention.
Figure 2:
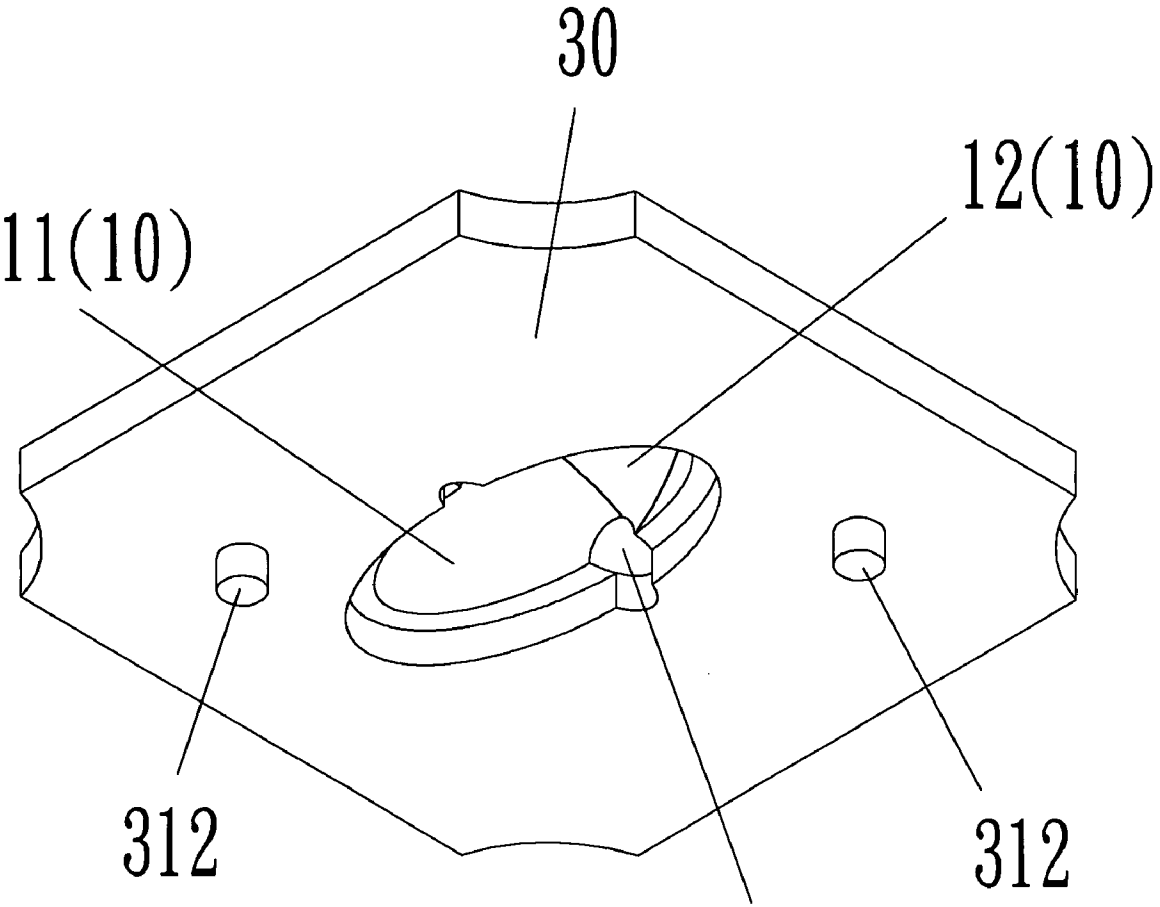
FIG. 2 is a schematic view of the preferable embodiment of the present invention from a bottom side.
Figure 3:
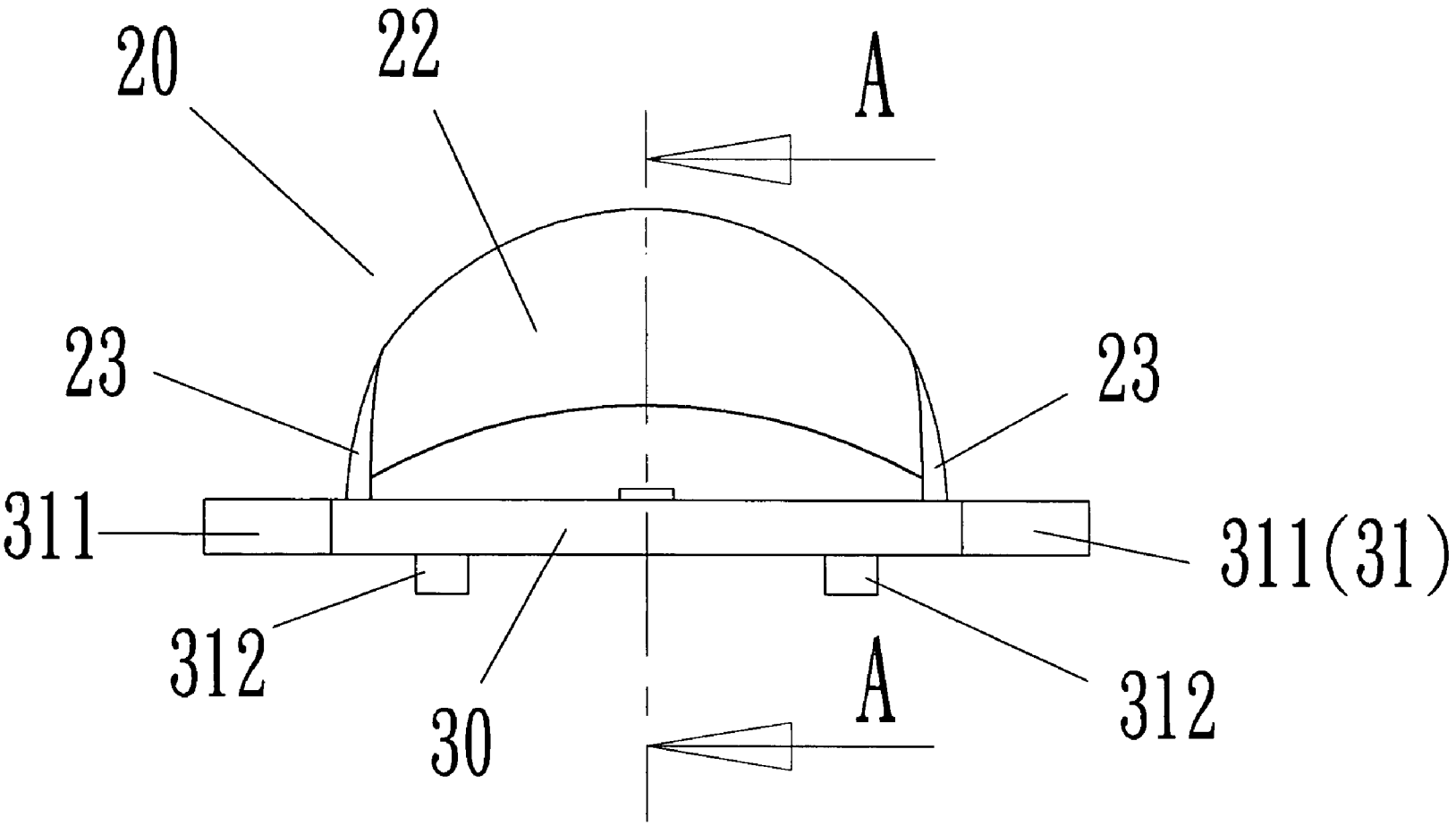
FIG. 3 is a front view of the preferable embodiment of the present invention.
Figure 4:
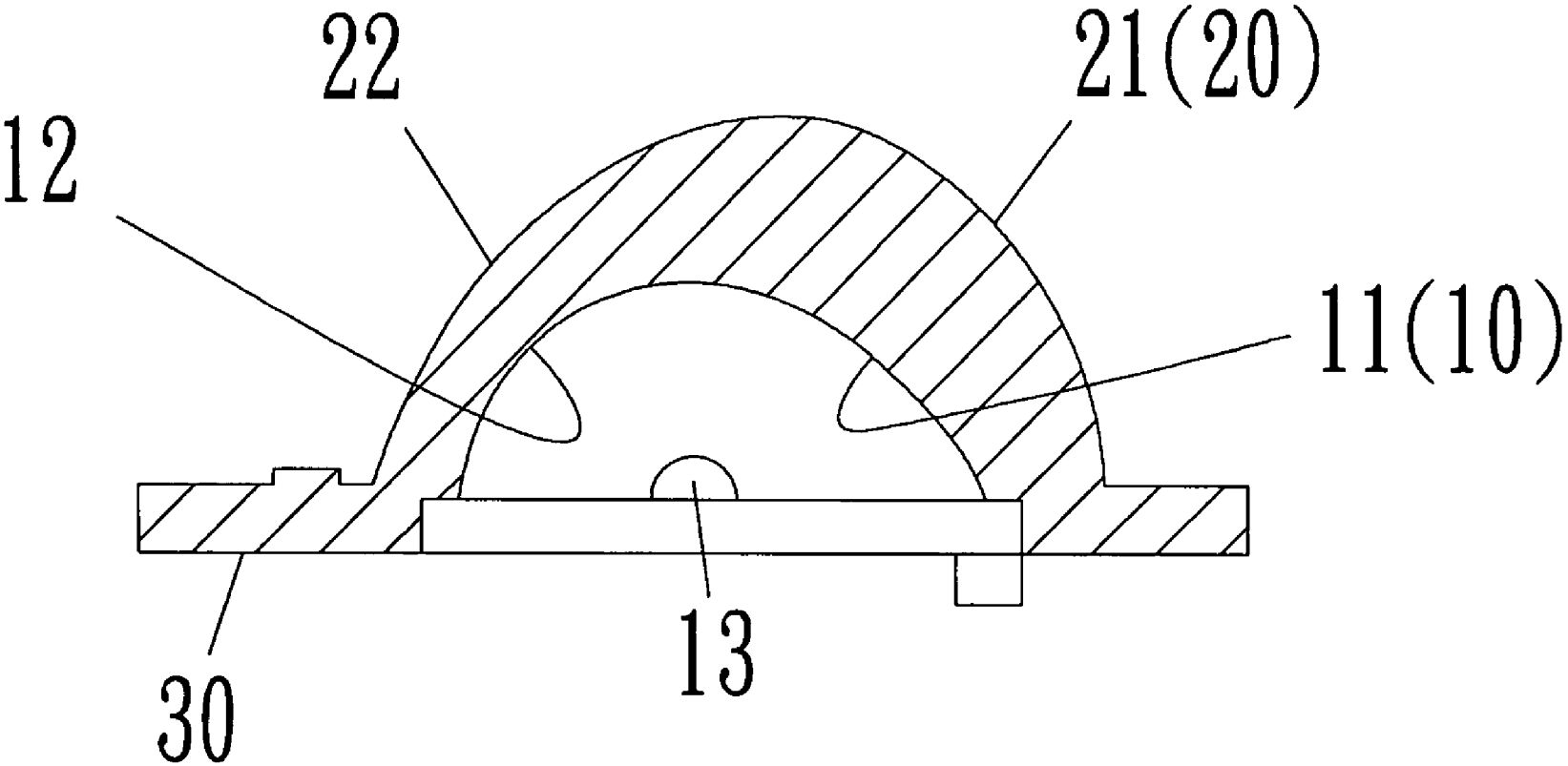
FIG. 4 is a cross section view from an A-A line of FIG. 3.
Figure 5:
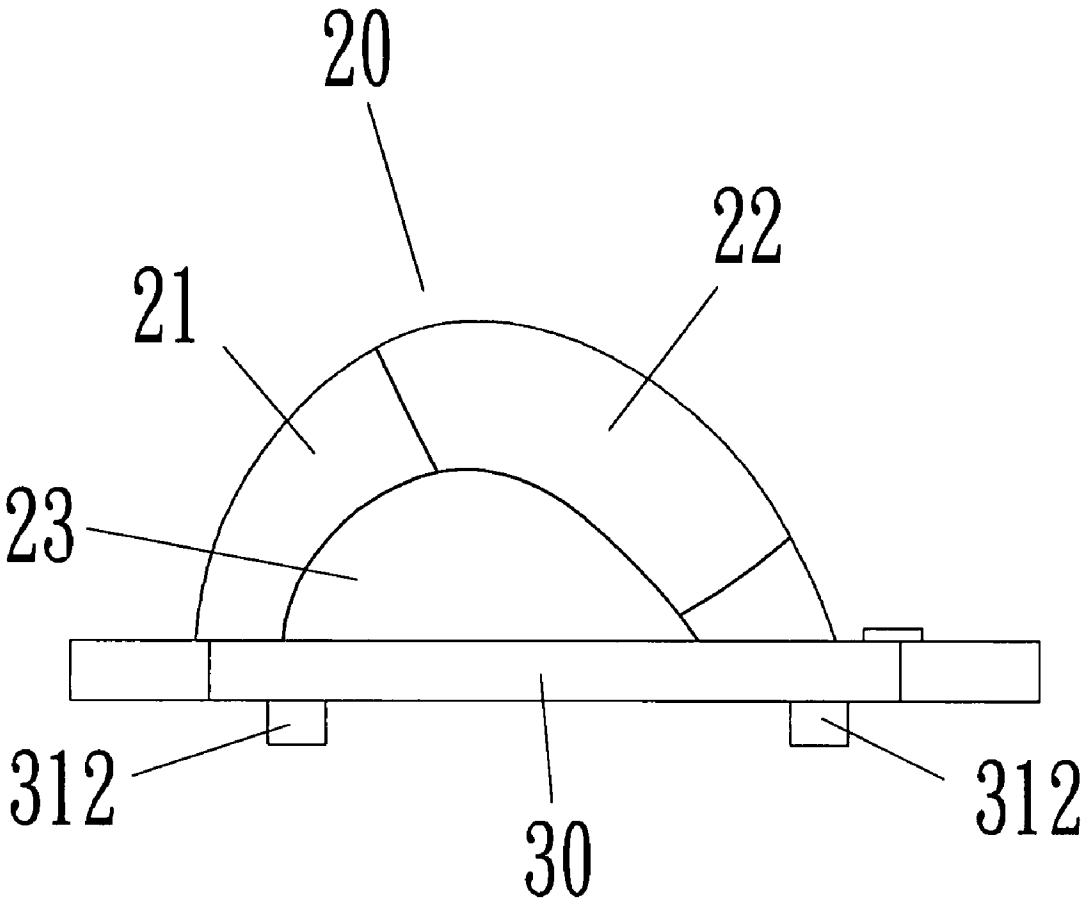
FIG. 5 is a side view of the preferable embodiment of the present invention.
Figure 6:
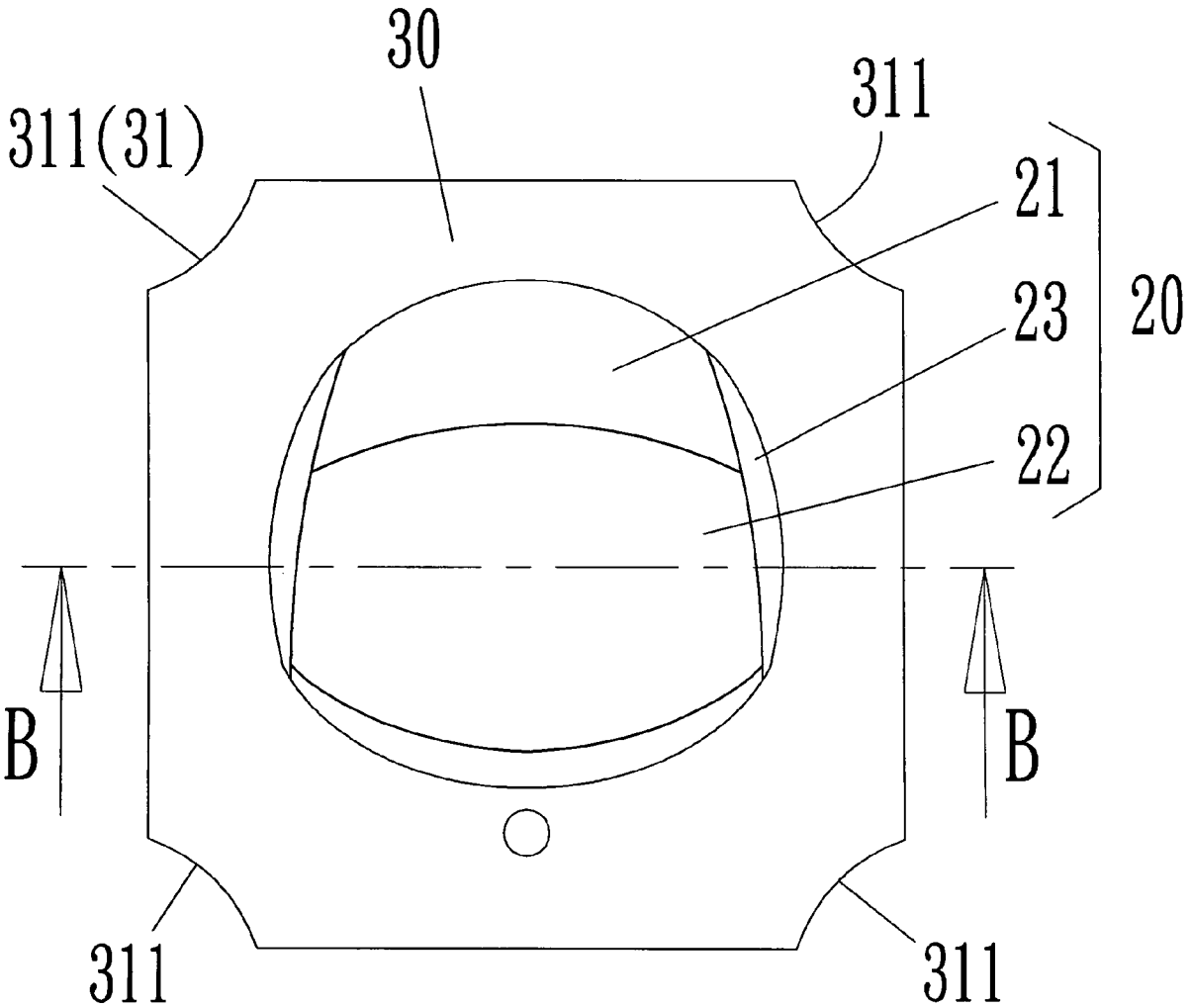
FIG. 6 is a top view of the preferable embodiment of the present invention.
Figure 7:
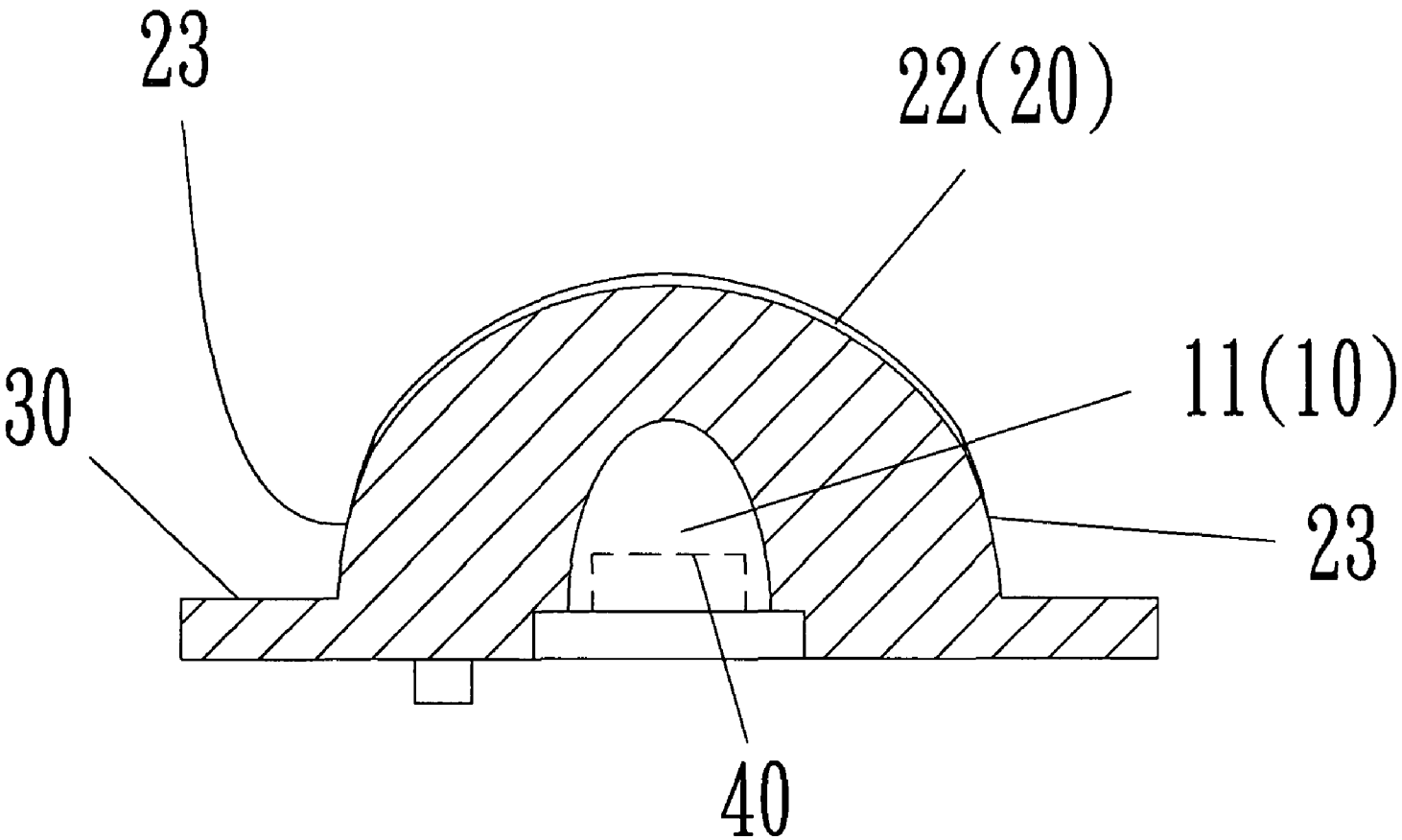
FIG. 7 is a cross section view from a B-B line of FIG. 6.
Figure 8:
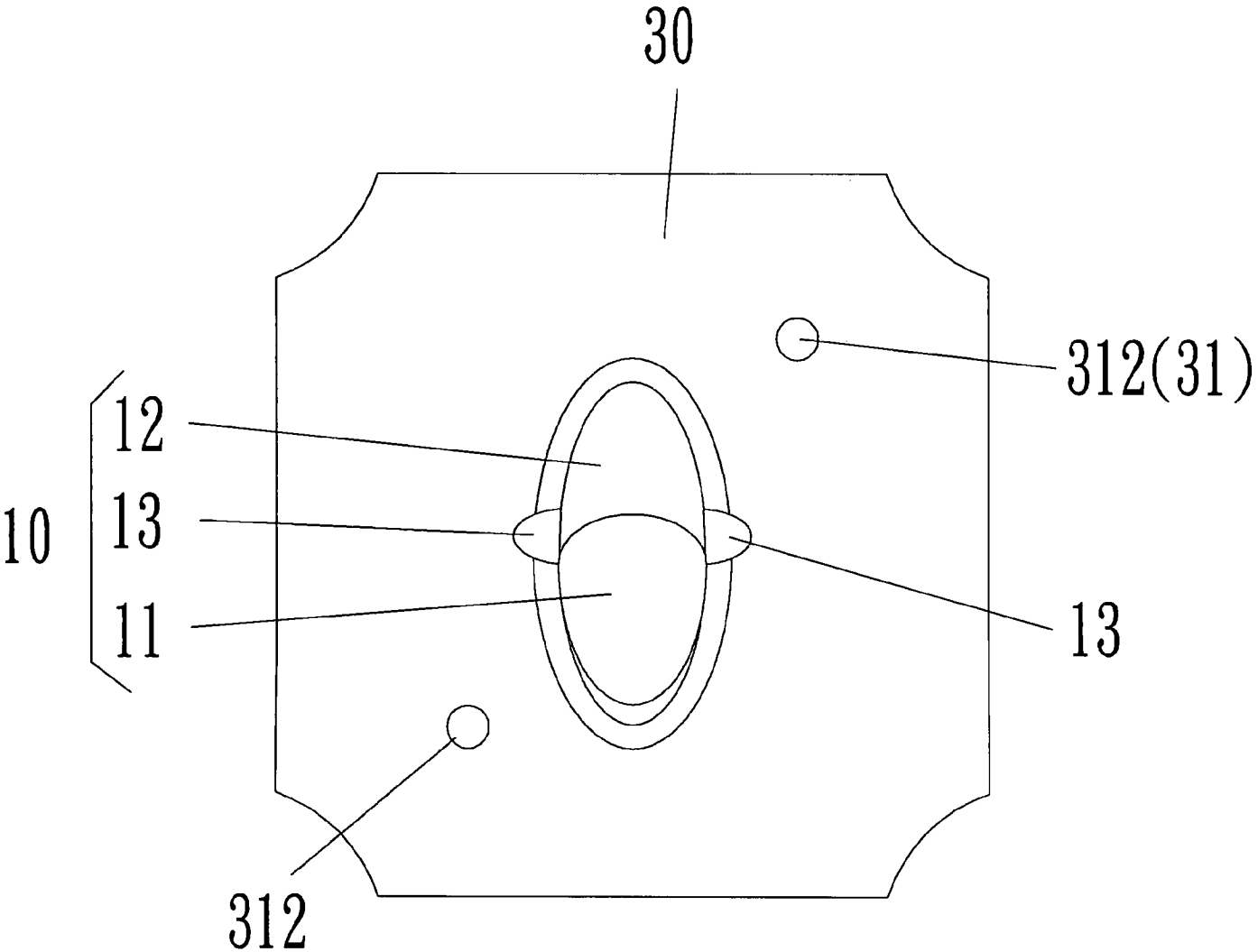
FIG. 8 is a bottom view of the preferable embodiment of the present invention.

The incident surface 10 consists of a plurality of curved surfaces. A first oval-shaped incident surface 11 and a second oval-shaped incident surface 12 are formed to the incident surface 10. The two adjacent oval-shaped incident surfaces 11 and 12 are formed side by side and are concave for receiving an illuminating component 40 (as shown in FIG. 7). Two symmetric inner connecting surfaces 13 are formed to two lateral sides of the incident surface 10. The connecting surfaces 13 are also oval-shaped concave surfaces in the embodiment so as to guide the transverse light for a desire distribution of illumination.

The illuminating component 40 mentioned above is a light emitting diode in the embodiment, and the light emitting diode has an illuminating angle between 90 to 135 degrees defined by a Full Width at Half Maximum (FWHM) of the light emitting diode.

The projection surface 20 also consists of a plurality of oval-shaped surfaces. A first oval-shaped projection surface 21 and a second oval-shaped projection surface 22 are formed to the projection surface 20. The two adjacent oval-shaped projection surfaces 21 and 22 are formed side by side and are convex. A surface area of the projection surface 20 is larger than that of the incident surface 10. Two symmetric outer connecting surfaces 23 are formed to two lateral sides of the projection surface 20.

By the incident surface 10 and the projection surface 20 mentioned above, lights pass through the optic lens assembly will have distribution describing in the following.

1. Lights from the illuminating component 40 will pass through the incident surface 10 and be refracted and reflected by the projection surface 20 so as to correct the path of the lights. An intensity of illumination will be above 300 cd/klm at a perpendicular angle of 60 degrees and vertical angle between 65 to 95 degrees which is also a standard of CNS for road illumination device in Taiwan.

2. The uniformity of the illuminating device through the optic lens assembly will also become higher than the standard mentioned above and will have wider transverse projection.

The platform 30 further has a retaining unit 31 for connecting a predetermined illuminating device (not shown in Figs.). The retaining unit 31 can be varied depending on the illumination device applied on it. In the present embodiment, the platform 30 has symmetric concave notches 311 on four corners thereof. Two pins 312 are formed to a side of the platform 30 opposite to the incident surface 10. The pins 312 locate diagonally by an opening to the incident surface 10.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An optic lens assembly comprising:

a platform having an incident surface and a projection surface arranged to an outer side of the platform;

the incident surface being concave;

the projection surface being convex;

wherein the incident surface and the projection surface both consist of a plurality of curved surfaces, wherein the incident surface comprises a first incident surface and a second incident surface covering a center area thereof and the first incident surface and the second incident surface are asymmetric, wherein the projection surface comprises a first projection surface and a second projection surface covering a center area thereof and the first projection surface and the second projection surface are asymmetric.

2. The optic lens assembly as claimed in claim 1, wherein the first incident surface is a first oval-shaped incident surface and the second incident surface is a second oval-shaped incident surface covering the center area thereof, wherein the first projection surface is a first oval-shaped projection surface and the second projection surface is a second oval-shaped projection surface covering the center area thereof.

3. The optic lens assembly as claimed in claim 2, wherein the projection surface further comprises two symmetric outer connecting surface formed to two lateral sides of the projection surface.

4. The optic lens assembly as claimed in claim 1, wherein the incident surface further has two symmetric inner connecting surfaces formed two lateral sides of the incident surface in such a manner that the incident surface is a smooth curved surface formed by the first oval-shaped incident surface, the second oval-shaped incident surface and the two symmetric inner connecting surfaces on the two lateral sides of the incident surface.

5. The optic lens assembly as claimed in claim 4, wherein the inner connecting surfaces are oval-shaped concave surfaces, thereby the incident surface is a concave curved surface.

6. The optic lens assembly as claimed in claim 2, wherein the first oval-shaped projection surface and the second oval-shaped projection surface are the asymmetric curved surface continuously formed side by side.

7. The optic lens assembly as claimed in claim 6, wherein the center area of the projection surface is a smooth curved surface formed by the first oval-shaped projection surface and the second oval-shaped projection surface.

8. The optic lens assembly as claimed in claim 6, wherein the projection surface further includes two symmetric outer connecting surfaces formed to two lateral sides of the projection surface in such a manner that the projection surface is a smooth curved surface formed by the first oval-shaped projection surface, the second oval-shaped projection surface and the two symmetric inner connecting surfaces on the two lateral sides of the projection surface.

9. An optic lens assembly for refracting and reflecting a light from a Light Emitting Diode so as to correct a path of the light, comprising:

a platform for disposing the Light Emitting Diode thereon; and an optic lens providing on the platform and having an incident surface and a projection surface arranged to an outer side of the platform;

the incident surface being a continuous concave surface;

the projection surface being a continuous convex surface;

wherein the incident surface has a first oval-shaped incident surface and a second oval-shaped incident surface extended adjacent to the first oval-shaped incident surface;

wherein the projection surface has a first oval-shaped projection surface and a second oval-shaped projection surface extended adjacent to the first oval-shaped projection surface;

wherein two symmetric outer connecting surfaces are formed to two lateral sides of the projection surface;

wherein the incident surface and the projection surface of the optic lens are provided and arranged in such a manner that when the light is passed through the incident surface, the light is refracted and reflected by the projection surface so as to correct the path of the light while transverse light is guided by the outer connecting surfaces for providing a particular distribution of illumination, wherein a maximum intensity of illumination is able to be distributed at a perpendicular angle of 60 degrees and a vertical angle between 65 to 95 degrees while the Light Emitting Diode with an illuminating angle between 90 to 135 degrees defined by a Full Width at Half Maximum (FWHM) is used as an illumination source.

10. The optic lens assembly as claimed in claim 9, wherein the first oval-shaped incident surface and the second oval-shaped incident surface, and the two symmetric outer connecting surfaces on the two lateral sides of the projection surface are positioned in a preset manner such that the intensity of the light through the optic lens assembly is higher than 300 cd/klm.

11. The optic lens assembly as claimed in claim 9, wherein the incident surface has two symmetric inner connecting surfaces formed to two lateral sides of the incident surface.

12. The optic lens assembly as claimed in claim 9, wherein the platform has a retaining unit for connecting the Light Emitting Diode.

13. The optic lens assembly as claimed in claim 12, wherein the platform has symmetric concave notches on four corners thereof.

14. The optic lens assembly as claimed in claim 12, wherein at least two pins are formed to a side of the platform opposite to the incident surface; the pins locate diagonally by an opening to the incident surface.

15. An optic lens assembly for refracting and reflecting a light from an illuminating component so as to correct a path of the light, comprising:

a platform for disposing the illuminating component thereon; and an optic lens providing on the platform and having an incident surface and a projection surface opposite to the incident surface on an outer side of the platform, wherein the incident surface is a smooth concave surface defining a surface area of the incident surface and has a plurality of asymmetric curved surfaces continuously extended side by side, wherein the projection surface is a smooth convex surface defining a surface area of the projection surface which is greater than the surface area of the incident surface, wherein the projection surface has a plurality of asymmetric curved surfaces continuously extended side by side, wherein the incident surface and the projection surface are provided and arranged in such a manner that a maximum intensity of illumination is distributed at a perpendicular angle of 60 degrees and a vertical angle between 65 to 95 degrees while the illuminating component with an illuminating angle between 90 to 135 degrees defined by a Full Width at Half Maximum (FWHM) is used as an illumination source, wherein the intensity of the light through the optic lens is higher than 300 cd/klm.

16. The optic lens assembly as claimed in claim 15, wherein the incident surface has at least first and second oval-shaped incident surfaces formed side by side covering a center area of the incident surface.

17. The optic lens assembly as claimed in claim 16, wherein the projection surface has at least first and second oval-shaped projection surfaces formed side by side covering a center area of the projection surface.

18. The optic lens assembly as claimed in claim 17, wherein the incident surface further has two symmetric oval-shaped inner connecting surfaces formed to two lateral sides of the incident surface to guide a transverse light for a desire distribution of illumination.

19. The optic lens assembly as claimed in claim 17, wherein the projection surface further has two symmetric outer connecting surfaces on two lateral sides of the projection surface arranged for light intensity adjustment in a horizontal direction.

20. The optic lens assembly as claimed in claim 18, wherein the projection surface further has two symmetric outer connecting surfaces on two lateral sides of the projection surface arranged for light intensity adjustment in a horizontal direction.

* * * * *